US011696370B2

(12) United States Patent
Khizar et al.

(10) Patent No.: US 11,696,370 B2
(45) Date of Patent: Jul. 4, 2023

(54) HOUSEHOLD APPLIANCE WITH IMMERSIBLE HEATER

(71) Applicant: WHIRLPOOL CORPORATION, Benton Harbor, MI (US)

(72) Inventors: Muhammad Khizar, Saint Joseph, MI (US); Ermanno Buzzi, Varese (IT); Andrea Cesaroni, Jesi (IT); Townsley R. Curtis, Stevensville, MI (US); Massimo Gobbetti, Fabriano (IT); Tolga Gonulluleroglu, Azzate-Varese (IT)

(73) Assignee: Whirlpool Corporation, Benton Harbor, MI (US)

( * ) Notice: Subject to any disclaimer, the term of this patent is extended or adjusted under 35 U.S.C. 154(b) by 564 days.

(21) Appl. No.: 16/855,007

(22) Filed: Apr. 22, 2020

(65) Prior Publication Data

US 2021/0337634 A1 Oct. 28, 2021

(51) Int. Cl.
*H05B 3/82* (2006.01)

(52) U.S. Cl.
CPC ..... *H05B 3/82* (2013.01)

(58) Field of Classification Search
CPC ..... D06F 39/02; D06F 39/022; D06F 39/04; D06F 39/083; D06F 39/085; D06F 39/088; A47L 15/4202; A47L 15/4208; A47L 15/4209; A47L 15/4214; A47L 15/4219; A47L 15/4223; A47L 15/4225; A47L 15/4246; A47L 15/428; A47L 15/4285; A47L 15/4293; H05B 3/0014; H05B 3/04; H05B 3/145; H05B 3/26; H05B 3/28; H05B 3/38; H05B 3/78; H05B 3/82; H05B 2214/04
See application file for complete search history.

(56) References Cited

U.S. PATENT DOCUMENTS

| | | | |
|---|---|---|---|
| 6,054,690 | A | 4/2000 | Petit et al. |
| 6,218,647 | B1 | 4/2001 | Jones |
| 8,581,158 | B2 | 11/2013 | Heintz et al. |
| 9,505,934 | B2 | 11/2016 | Ko et al. |
| 10,010,238 | B2 | 7/2018 | Miller et al. |
| 10,086,158 | B2 | 10/2018 | Bath et al. |
| 10,134,502 | B2 | 11/2018 | Elverud |
| 2005/0067406 | A1 | 3/2005 | Rajarajan et al. |

(Continued)

FOREIGN PATENT DOCUMENTS

| | | | |
|---|---|---|---|
| CN | 2594719 | Y | 12/2003 |
| CN | 101282597 | A | 10/2008 |

(Continued)

OTHER PUBLICATIONS

European Search Report for Counterpart EP211623295.5, 7 Pages, dated Jun. 15, 2021.

*Primary Examiner* — Hung D Nguyen
(74) *Attorney, Agent, or Firm* — McGarry Bair PC

(57) ABSTRACT

A household appliance is configured to implement an automatic cycle of operation for treating an article. The household appliance includes a treating chamber configured to receive the article for treatment according to the automatic cycle of operation. A sump is fluidly coupled to the treating chamber. A liquid circuit is fluidly coupled to at least one of the treating chamber or the sump. An immersible heater is located within the sump.

19 Claims, 6 Drawing Sheets

(56) References Cited

U.S. PATENT DOCUMENTS

| | | | | |
|---|---|---|---|---|
| 2012/0000899 | A1 | 1/2012 | Eom et al. | |
| 2012/0305035 | A1 | 12/2012 | Mak et al. | |
| 2014/0060595 | A1* | 3/2014 | Alexander | D06F 34/28 134/56 R |
| 2019/0136073 | A1 | 5/2019 | Bake et al. | |
| 2019/0330779 | A1* | 10/2019 | Li | D06F 39/085 |

FOREIGN PATENT DOCUMENTS

| | | | | |
|---|---|---|---|---|
| CN | 100558833 | C | | 11/2009 |
| CN | 110418442 | A | | 11/2019 |
| DE | 3708440 | A1 | * | 12/1987 |
| DE | 3708440 | A1 | | 12/1987 |
| DE | 102011089757 | A1 | | 6/2013 |
| EP | 1004266 | A1 | | 5/2000 |
| EP | 1293597 | B1 | | 12/2009 |
| EP | 2638776 | A1 | | 9/2013 |
| EP | 3182032 | A1 | | 6/2017 |
| EP | 3272931 | A1 | | 1/2018 |
| KR | 101128033 | B1 | | 4/2012 |
| KR | 101642701 | B1 | | 8/2016 |
| KR | 101698841 | B1 | | 1/2017 |
| KR | 101745440 | B1 | | 6/2017 |
| KR | 2019-0065223 | A | * | 6/2019 |
| KR | 20190065223 | A | | 6/2019 |
| WO | 2012062572 | A1 | | 5/2012 |
| WO | 2016186316 | A1 | | 11/2016 |

* cited by examiner

HOUSEHOLD APPLIANCE WITH IMMERSIBLE HEATER

TECHNICAL FIELD

This description relates to a household appliance, and more specifically to a household appliance with an immersible heater.

BACKGROUND

Household appliances perform a variety of cycles of operation on various articles. In one form or another, most household appliances have a treating chamber holding an article that is treated according to a cycle of operation. For example, laundry treating appliances, such as clothes washers/dryers, have a treating chamber in which an article, such as a laundry item, is placed for a washing, refreshing, de-wrinkle, drying, or other cycle of operation. Dish treating appliances, such as dishwashers, have a treating chamber in which a dish is placed for washing, sanitizing, or other cycle of operation. Refrigerating appliances having a treating chamber, such as a cooler or freezer, in which articles are cooled or frozen, respectively. Such refrigerating appliances can also be configured to implement a thawing function or cycle wherein a heater can provide heat to at least a portion of the refrigerating appliance to thaw items within the refrigerating appliance without having to remove the items from the refrigerating appliance. Cooking appliances, such as ovens and microwaves, have a treating chamber in which articles, such as food items, are heated or cooked. These examples are merely illustrative. Such household appliances can have a controller that implements a number of user-selectable, pre-programmed cycles of operation having one or more operating parameters. The user can select the desired cycle of operation.

Such household appliances include a structure, such as a tub, that can have an access opening and which at least partially defines the treating chamber into which items or articles can be placed to undergo a treating cycle of operation. A closure, such as a door assembly, is provided to selectively open or close the access opening to allow or prevent user access to the treating chamber.

In appliances that use water or other liquids as part of or as a byproduct of the cycle of operation, a sump can be provided with or fluidly coupled to the tub and can have a heater or heating element to heat liquid present within the sump. The heaters can be located external to the sump and indirectly heat the liquid in the sump by heating the sump. The heaters located within the sump are immersible and directly heat the surrounding water or liquid. Immersible heaters, since they are exposed to the water/liquid, are subjected to harsher conditions than the external heaters. For example, immersible heaters are subject to limescale or calcium buildup, which, depending on the hardness of the water/liquid, can build up on the heater and degrade the efficiency of the heater.

BRIEF DESCRIPTION

An aspect of the present disclosure relates to a household appliance configured to implement an automatic cycle of operation for treating an article, the household appliance comprising a treating chamber configured to receive the article for treatment according to the automatic cycle of operation, a sump fluidly coupled to the treating chamber, a liquid circuit fluidly coupled to at least one of the treating chamber or the sump, an immersible heater located within the sump, and a mechanical vibrator physically coupled to the immersible heater.

Another aspect of the present disclosure relates to a household appliance configured to implement an automatic cycle of operation for treating an article, the household appliance comprising a treating chamber configured to receive the article for treatment according to the automatic cycle of operation, a sump fluidly coupled to the treating chamber, a liquid circuit fluidly coupled to at least one of the treating chamber or the sump, and an immersible laminate heater located within the sump and having a pair of electrodes and a laminate structure comprising a thermoresistive nano-coating heater layer electrically connected to the pair of electrodes, a liquid-impermeable and electrically non-conductive second barrier layer abutting the heater layer, and a superhydrophobic nano-coating protective layer abutting the second barrier layer.

Yet another aspect of the present disclosure relates to an immersible heating element comprising a pair of electrodes, a mechanical vibrator coupled to the immersible heating element and configured to mechanically vibrate the immersible heating element, and a laminate structure comprising a thermoresistive nano-coating heater layer electrically connected to the pair of electrodes, a liquid-impermeable and electrically non-conductive second barrier layer abutting the heater layer, and a superhydrophobic nano-coating protective layer abutting the second barrier layer.

DETAILED DESCRIPTION

Figure 1:
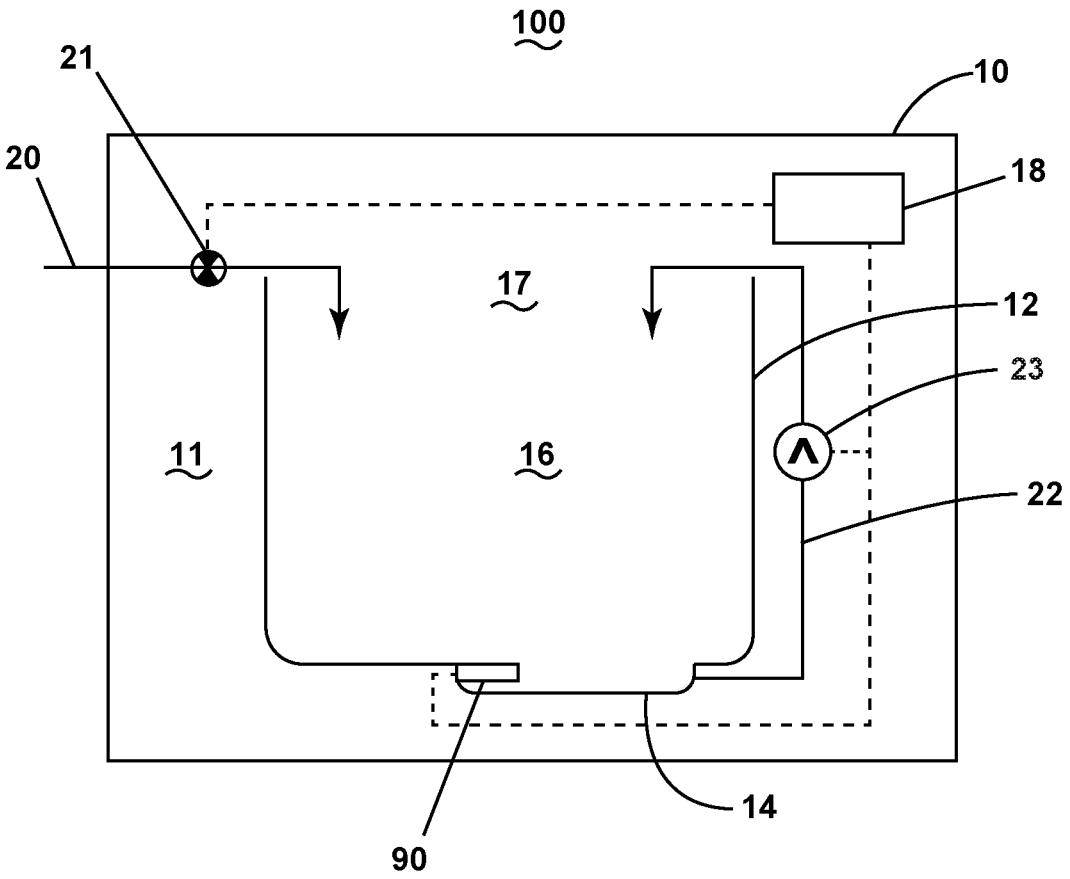
FIG. 1 is a schematic representation of a household appliance including a treating chamber and an immersible heater.

FIG. 1 illustrates a schematic representation of a household appliance 100 according to aspects of the present disclosure. The household appliance 100 can be any suitable household appliance, including, but not limited to, a dish treating appliance, a dishwasher having varying widths, sizes, and capacities, a stand-alone dishwasher, a multi-tub-type dishwasher, a drawer-type dishwasher, a sink-type dishwasher, a laundry treating appliance, a clothes washing machine, a clothes dryer, a combination washing machine and dryer, a dispensing dryer, a tumbling or stationary refreshing/revitalizing machine, an extractor, a non-aqueous washing apparatus, a clothes refresher, a revitalizing machine, etc. All of these examples of household appliances can receive one or more items in a treating chamber and then perform a cycle of operation on the article. The cycle of operation can include, by way of non-limiting example, cooking, heating, cooling, freezing, clothes washing, clothes drying, clothes treating, dish drying, dish washing, or dish treating. As used in this description, the term "items" is intended to be generic to any item, single or plural, that can be treated in the household appliance 100, including, without limitation, dishes, plates, pots, bowls, pans, glassware, silverware, other utensils, laundry items, clothes, bedding, towels, and food items.

The household appliance 100 includes a cabinet 10 with an interior 11, in which is provided a tub 12 that at least partially defines a treating chamber 16, with an access opening 17. A liquid sump 14 is fluidly coupled with the tub 12 and can be at least partially formed by the tub 12, or alternatively can be provided adjacent to or otherwise fluidly coupled with the tub 12. Alternatively, the liquid sump 14 can be a separate module that is coupled to the tub 12.

The household appliance 100 further includes a household water supply circuit in the form of a water supply line 20 and a water inlet valve 21, which controls the flow of water through the water supply line 20. The water supply line 20 can be fluidly coupled to a household water supply, thus, with the operation of the water inlet valve 21, water from the household water supply can be supplied to the treating chamber 16.

A liquid circuit 22 fluidly connects the liquid sump 14 to at least one of the treating chamber 16 or tub 12. A valve or a recirculation system pump 23 can control the flow of liquid through the liquid circuit 22. The liquid circuit 22 distributes or recirculates liquid from the liquid sump 14 to at least one of the treating chamber 16 or tub 12 and thus can be thought of as a distribution or a recirculation liquid circuit 22.

An immersible heater 90 can be included for heating the liquid in the liquid sump 14. By way of non-limiting example, the immersible heater 90 can be provided within or adjacent the treating chamber 16 or within or adjacent the liquid sump 14. The immersible heater 90 need only be located such that it is at least partially immersed in the liquid present within at least one of the treating chamber 16 or the liquid sump 14. As illustrated, the immersible heater 90 extends into and overlies at least a portion of the liquid sump 14, but does not lie on a surface of the liquid sump 14. However, it is contemplated that the immersible heater 90 can reside adjacent to or rest on a portion of the liquid sump 14.

To implement the cycles of operation, a controller 18 can also be included in the household appliance 100 that operably couples with and controls the various components of household appliance 100 including the water inlet valve 21, the recirculation system pump 23, and the immersible heater 90. The controller 18 can be located within the cabinet 10 as illustrated, or it can alternatively be located within a closure, such as a door or closure, of the household appliance 100.

Figure 2:
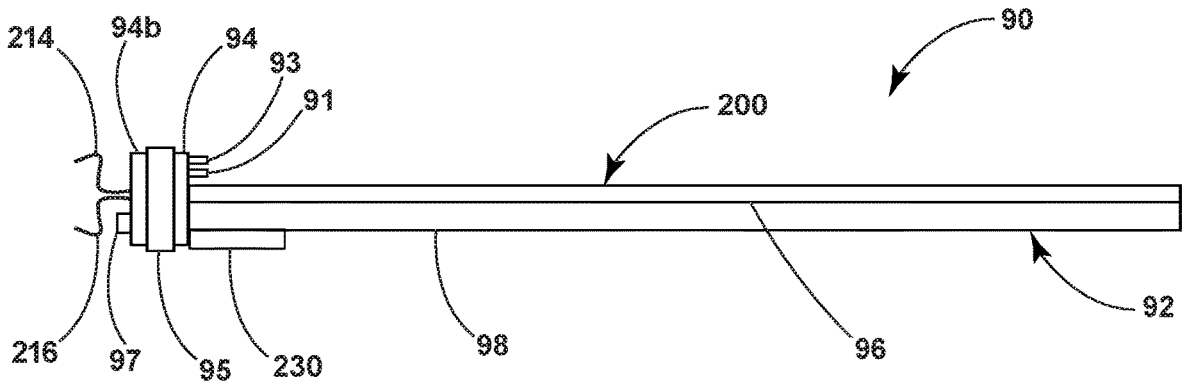
FIG. 2 is a schematic side view of the immersible heater of FIG. 1.

Turning now to FIG. 2, the immersible heater 90 comprises a heater body 92 extending from a heater base 94. The heater body 92 can be coupled to the heater base 94 by any suitable method. In one non-limiting example, the heater body 92 is welded to the heater base 94. The heater body 92 can be fully immersible and can protrude into the liquid sump 14, such as by protruding through a wall of the liquid sump 14 or by protruding through the tub 12, while the heater base 94 can have at least a portion **94*b* that is not immersible and is positioned outside of the liquid sump 14 or the tub 12. A gasket 95 can be provided with the heater base 94 for providing a seal where the heater base 94 protrudes through the liquid sump 14 or the tub 12 and to prevent liquid from reaching the non-immersible portion 94*b* of the heater base 94. By way of non-limiting example, the gasket 95** can be formed of thermoplastic elastomer (TPE).

The immersible heater 90 includes a temperature sensor 91, a ground sensor 93, and a fastener 97 that can be carried by the heater base 94. By way of non-limiting example, the temperature sensor 91 and the ground sensor 93 can be positioned on the heater base 94 such that the temperature sensor 91 and the ground sensor 93 extend into, contact, or abut an interior of the liquid sump 14, while the fastener 97 is carried by and protrudes from the non-immersible portion **94*b* of the heater base 94. The fastener 97 can be any type of fastener 97 suitable for fastening the immersible heater 90 to the tub 12 or to the liquid sump 14. In one non-limiting example, the fastener 97 can be provided as a screw or bolt that can be tightened against the tub 12 or the liquid sump 14. The temperature sensor 91 can be any suitable type of temperature sensor 91 for sensing the temperature of at least one of the air or liquid within the liquid sump 14. The ground sensor 93 can be any type of ground sensor 93 suitable for providing a ground connection for the immersible heater 90**.

The immersible heater 90 can further comprise at least one of a laminate structure 200 provided on at least a portion of the heater body 92 and a mechanical vibrator 230 physically coupled to the immersible heater 90. Wires 214, 216 extend from the heater base 94 and are operably coupled with the controller 18 and with the immersible heater 90 to connect and electrically couple the controller 18 with the immersible heater 90, such as specifically with the laminate structure 200.

In one non-limiting example, the immersible heater 90 comprises a plate heater 90 wherein a heating plate 92 is provided as the heater body 92. In such an example, the heater body 92 can be an entirely flat or planar heating plate 92, the heater body 92 can be provided as a curved heating plate 92, or the heater body 92 can be provided as a heating plate 92 having multiple flat or planar portions arranged to form a non-planar profile, such as a tented, peaked, or v-shape. It will be understood that, in addition to the described examples, the heater body 92 can have any suitable shape or profile, including a combination of any of the previously described examples. It will be further understood that, while the heater body 92 has been described in the present example as comprising a heating plate 92, it is also contemplated that the heater body 92 can be any suitable type or shape of heater body 92, non-limiting examples of which include heating plates, heating coils, tubular heaters, non-tubular heating elements, and rod-type heating elements. The heater body 92 has at least a first surface 96 and a second surface 98. In one example, the second surface 98 is opposite the first surface 96, though it will be understood that the first surface 96 and the second surface 98 are not required to be opposing surfaces 96, 98.

As illustrated herein, the mechanical vibrator 230 that is physically coupled to the immersible heater 90 is provided on and at least partially abuts the second surface 98 of the heater body 92, opposite the laminate structure 200. However, it will be understood that the mechanical vibrator 230 can be positioned at any suitable location of the immersible heater 90, non-limiting examples of which include on the heater body 92, within the liquid sump 14, or along the heater base 94, outside of the liquid sump 14. Any position on the immersible heater 90 is suitable so long as the mechanical vibrator 230 can transmit vibration to at least a portion of the immersible heater 90, and in particular to at least a portion of the heater body 92. For example, locating the mechanical vibrator 230 along the heater body 92 may result in most efficient transfer of vibration from the mechanical vibrator 230 to the heater body 92, but also requires the mechanical vibrator 230 to be exposed to liquid, while locating the mechanical vibrator 230 along the heater base 94 may not transfer as much vibration to the heater body 92, but would remove the mechanical vibrator 230 from the liquid environment. The mechanical vibrator 230 can be physically coupled to the immersible heater 90 in any suitable manner, non-limiting examples of which include by mounting the mechanical vibrator 230 to the immersible heater 90, by fastening the mechanical vibrator 230 to the immersible heater 90, by embedding the mechanical vibrator 230 to the immersible heater 90, or by indirectly physically coupling the mechanical vibrator 230 to the immersible heater 90.

The mechanical vibrator 230 can be any suitable type of mechanical agitator or mechanical vibrator 230 capable of vibrating or transmitting vibration to the immersible heater 90. By way of non-limiting example, the mechanical vibrator 230 can be an electromagnetic mechanical vibrator 230, a vibration motor capsule, and/or a fully encapsulated direct current (DC) vibration motor. It is also contemplated that the mechanical vibrator 230 can produce vibration or mechanical noise by a motor that is capable of rotation in either a clockwise or a counterclockwise direction, or both. Providing a mechanical vibrator 230 having a compact size can also be desirable in order to conform with the space constraints within the household appliance 100. By way of non-limiting example, the mechanical vibrator 230 can be capable of producing mechanical noise in a range of approximately 30-50 decibels, can have a cylindrical shape with a diameter of approximately 0.88 millimeters and a length of 1.49 centimeters, can be rated at 3 V DC, can have a rated current of 250 mA, and can have an operating temperature range of −22° F. to 194° F. (−30° C. to 90° C.). The mechanical vibrator 230 can be operable at a single constant frequency of vibration, or the mechanical vibrator 230 can be operable at more than one single frequency of vibration, such as at variable frequencies of vibration.

In the example where the immersible heater 90 includes the laminate structure 200, the immersible heater 90 can be thought of as a laminate immersible heater 90 comprising the laminate structure 200. The laminate structure 200, which can be thought of as a multilayer composite, and therefore also the immersible heater 90, have thermoresistive heating capabilities and are configured to perform heating of at least a portion of the liquid in the liquid sump 14 by thermoresistively heating the portion of the liquid in the liquid sump 14. The laminate structure 200 can be provided on at least a portion of the immersible heater 90 and on any suitable portion of the immersible heater 90. In one example, the laminate structure 200 can be provided on at least the first surface 96 of the heater body 92, such that the first surface 96 of the heater body 92 is provided as a support layer 96 for the laminate structure 200 to provide structural support for the laminate structure 200.

It will be understood that the inclusion of the support layer 96 is not required for the laminate structure 200. In some contemplated examples, the laminate structure 200 can reside on or be located on a portion of the liquid sump 14 or of the tub 12, reducing or eliminating the need for the support layer 96. Thus, it will be understood that the support layer 96 is most likely to be used when the immersible heater 90 is cantilevered relative to the tub 12 or relative to the liquid sump 14, as opposed to when the immersible heater 90 rests on a portion of the tub 12 or of the liquid sump 14. When the support layer 96 is included, the support layer 96, and thus the heater body 92, can comprise a rigid material, non-limiting examples of which include plastic, polymer materials, hybrid polymers, polytetrafluoroethylene (PTFE), carbon fiber, metal, hybrid metal composites, steel, copper, and/or aluminum, or a combination of any suitable rigid materials such that the support layer 96 can provide rigidity and structure to the laminate heater 90, and in particular such that the laminate structure 200 is structurally supported by the support layer 96.

The laminate structure 200 can be provided with a variety of immersible heaters 90 having support layers 96 of various compositions, and further is ideally suited to be applied to support layers 96 formed of metal, such as aluminum, or of other polymers that can withstand high temperatures. In one non-limiting example wherein the immersible heater 90 comprises the plate heater 90 with the heating plate 92 being provided as the heater body 92, the heater body 92 can be a metal plate heater body 92, further an aluminum plate heater body 92, with the aluminum plate heater body 92 defining the support layer 96 for the laminate structure 200. By way of non-limiting example, the laminate structure 200 can be a multilayer laminate structure 200 that can be coated onto the heater body 92, such as onto the support layer 96. By way of further non-limiting example, the laminate structure 200 can be provided as a nanocoating, and specifically as a thermoresistive nanocoating.

While the immersible heater 90 is illustrated herein as including both the laminate structure 200 and the mechanical vibrator 230, with the laminate structure 200 and the mechanical vibrator 230 provided on opposite sides or surfaces 96, 98 of the heater body 92 from one another, it will be understood that the laminate structure 200 and the mechanical vibrator 230 are not required to be located or positioned opposite one another about the heater body 92. Further, while the immersible heater 90 is illustrated herein as including both the laminate structure 200 and the mechanical vibrator 230, it will be understood that immersible heaters 90 including only one of the laminate structure 200 or the mechanical vibrator 230 coupled with the immersible heater 90 are still within the scope of the present disclosure.

Figure 3:
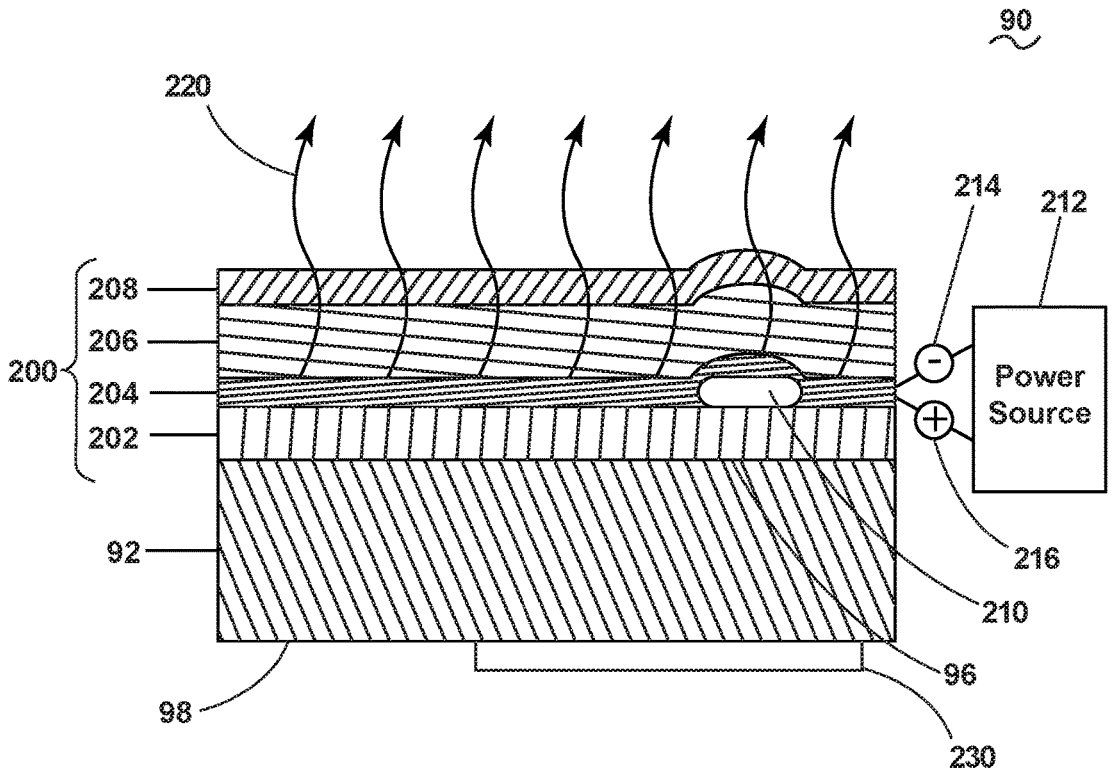
FIG. 3 is a schematic diagram illustrating a partial cross-section of the immersible heater of FIG. 1.

Turning now to FIG. 3, the laminate structure 200 can comprise an optional first barrier layer 202, a heater layer 204 abutting the first barrier layer 202, a second barrier layer 206 abutting the heater layer 204, and a protective layer 208 abutting the second barrier layer 206. The laminate structure 200 can further comprise at least one electrical connector 210 that is operably coupled and/or thermally coupled to the laminate structure 200 and configured to provide the thermoresistive heating capabilities of the laminate structure 200. The at least one electrical connector 210 can further be operably coupled with a power source 212 by the wires 214, 216, and specifically by at least a first wire 214 and a second wire 216 to complete an electrical circuit between the power source 212 and the at least one electrical connector 210.

In one example, the first wire 214 can be coupled to a negative power terminal (not shown) of the power source 212 while the second wire 216 can be coupled to a positive power terminal (not shown) of the power source 212. The power source 212, and thus also the first and second wires 214, 216, can be further operably coupled with the controller 18 of the household appliance 100 such that the controller 18 can selectively energize or provide electricity to the power source 212 and to the first and second wires 214, 216 to operate the immersible heater 90 to generate heat. By way of non-limiting example, the immersible heater 90 can operate with an alternating current (AC) electrical supply, for example a 30 A, 120 V, 230 V, 240 V supply, such that the immersible heater 90 generates 1700 Watts or greater.

The first and second wires 214, 216 can be any suitable type of electrically conductive coupler, such as nanowires having, by way of non-limiting example, a diameter of 2-4 nanometers. Further by way of non-limiting example, the first and second wires 214, 216 can comprise any electrically conductive material or combination of materials having an electrical conductivity $\sigma$ of greater than $5\times10^7$ S/m, such as copper. Since the first and second wires 214, 216 may extend through and protrude from the laminate structure 200 and into the liquid sump 14, the first and second wires 214, 216 can include an electrically insulating component, such as a coating or protective layer, to prevent the electrically conductive material from contacting the liquid in the liquid sump 14.

When included, the first barrier layer 202 can be provided directly onto the support layer 96 of the heater body 92, though it will be understood that the first barrier layer 202 could be provided indirectly on the support layer 96, such as by having an intervening layer or other component(s) provided between the support layer 96 and the first barrier layer 202. The first barrier layer 202 is provided such that the support layer 96 is on an opposite side of the first barrier layer 202 from the heater layer 204, with the first barrier layer 202 providing a barrier between the heater layer 204 and the support layer 96. The first barrier layer 202 is a liquid-impermeable and electrically non-conductive first barrier layer 202. The first barrier layer 202 can be configured to prevent thermal transfer between the laminate structure 200 and the support layer 96, or the first barrier layer 202 can be thermally transmissive to allow thermal transfer between the laminate structure 200 and the support layer 96. By way of non-limiting example, the first barrier layer 202 can have a thickness of approximately 0.3 millimeters. By way of non-limiting example, the first barrier layer 202 can be coated onto the support layer 96, though it will be understood that any suitable method of application can be used, other non-limiting examples of which can include laminating, spray coating, dip coating, or simply layering. The first barrier layer 202 can comprise any suitable material that is electrically insulating and has sufficient dielectric strength to withstand high voltage, such as, by way of non-limiting example, at least 1250V.

In one example, the at least one electrical connector 210 can be provided on the first barrier layer 202, either directly or indirectly, or abutting the first barrier layer 202, such as being positioned between the first barrier layer 202 and the heater layer 204. However, it will also be understood that the at least one electrical connector 210 can be provided on the heater layer 204 or between the heater layer 204 and second barrier layer 206, so long as the at least one electrical connector 210 is electrically and thermally coupled with the heater layer 204 for providing heat from the heater layer 204, and specifically such that the at least one electrical connector 210 is configured to provide heat to the heater layer 204 that can then be provided or thermally transferred outwardly from the heater layer 204.

The at least one electrical connector 210 can be provided as a copper electrode, though it will be understood that any suitable type of electrical connector 210 can be used. By way of non-limiting example, the at least one electrical connector 210 can comprise any electrically conductive material or combination of materials having an electrical conductivity $\sigma$ of greater than $5\times10^7$ S/m, such as copper or silver. Additionally, the at least one electrical connector 210 can comprise only a single electrical connector 210, to which both the first wire 214 and the second wire 216 can be coupled. Alternatively, the at least one electrical connector 210 can comprise at least two electrical connectors 210, wherein the first wire 214 is coupled to a first electrical connector 210 and the second wire 216 is coupled to a second electrical connector 210. In the case that more than one electrical connector 210 is included, the electrical connectors 210 can be provided adjacent one another, even abutting one another, or the electrical connectors 210 can be spaced from one another. Regardless of the number of electrical connectors 210 provided, the first wire 214 and the second wire 216 are coupled to the at least one electrical connector 210 to connect and electrically couple the controller 18 with the at least one electrical connector 210.

The heater layer 204 can be provided on and to at least partially abut the first barrier layer 202. In one example, the heater layer 204 can directly abut the first barrier layer 202, except where the at least one electrical connector 210 is provided between the two layers 202, 204, though it will also be understood that an intervening layer or component(s) can be provided between the first barrier layer 202 and the heater layer 204. In such an example, the at least one electrical connector 210 extends between the first barrier layer 202 and the heater layer 204 and is at least partially covered by the heater layer 204. In the case that more than one electrical connector 210 is included, the electrical connectors 210 can be positioned such that they are spaced from one another, with the heater layer 204 arranged to intervene between the electrical connectors 210 and to be in electrical connection with the electrical connectors 210. By way of non-limiting example, the heater layer 204 can be coated onto the first barrier layer 202, as well as onto the at least one electrical connector 210, though it will be understood that any suitable method of application can be used, other non-limiting examples of which can include laminating, spray coating, dip coating, painting, sputtering, or simply layering. By way of non-limiting example, the heater layer 204 can have a thickness of approximately 0.1-0.3 millimeters.

The heater layer 204 is a thermoresistive nanocoating heater layer 204 comprising a conductive material or materials, as well as at least one component that is electrically resistive. By way of non-limiting example, the heater layer 204 can comprise carbon nanoparticles, such as carbon nanotubes and graphene carbon nanotubes, which serve as an excellent conductor and can have a refractive index that gradually changes as the carbon nanotubes are exposed to infrared heat waves. Blending the carbon nanotubes with a high-temperature blending polymer agent can further improve conduction of the heater layer 204. In one example, such a polymer can include a polyurethane polymer, such as a two-system-based polyurethane polymer. The performance of the heater layer 204 can be further optimized through efficient utilization and selection of the carbon nanotubes, such as by ensuring that natural bundles of the carbon nanotubes are dispersed and that an appropriate functional group for the carbon nanotubes is used. The heater layer 204 can also comprise other materials including, but not limited to, aluminum nanoparticles, ceramics, and fillers.

It will be understood that, in some examples, the laminate structure 200 can be provided without including the first barrier layer 202. In such examples, the first barrier layer 202 is not included and the heater layer 204, as well as the at least one electrical connector 210, instead of being provided on and abutting the first barrier layer 202, can instead be provided directly or indirectly onto the support layer 96 of the heater body 92. By way of non-limiting example, it is contemplated that the laminate structure 200 can include the first barrier layer 202 when the support layer 96 of the heater body 92 is formed of an electrically conductive material, such as metal, while the laminate structure 200 can omit the first barrier layer 202 when the support layer 96 of the heater body 92 is formed of a material that is not electrically conductive, such as PTFE or a plastic polymer.

The second barrier layer 206 can be provided on and to at least partially abut the heater layer 204. The second barrier layer 206 can be provided directly onto the heater layer 204, though it will be understood that the second barrier layer 206 could be provided indirectly on the heater layer 204, such as by having an intervening layer or other component(s) provided between the heater layer 204 and the second barrier layer 206. The second barrier layer 206 is a liquid-impermeable and electrically non-conductive second barrier layer 206. The second barrier layer 206 can be configured to thermally transmit heat generated from the heater layer 204, as well as to prevent liquid from penetrating through the second barrier layer 206 to reach the heater layer 204 and/or the at least one electrical connector 210. By way of non-limiting example, the second barrier layer 206 can have a thickness of approximately 0.7-1.5 millimeters. Further by way of non-limiting example, the second barrier layer 206 can be coated onto the heater layer 204, though it will be understood that any suitable method of application can be used, other non-limiting examples of which can include laminating, spray coating, dip coating, or simply layering.

The second barrier layer 206 can comprise any suitable material that is electrically insulating and has sufficient dielectric strength to withstand high voltage, such as, by way of non-limiting example, at least 1250V. The second barrier layer 206 is provided such that the protective layer 208 is on an opposite side of the second barrier layer 206 from the heater layer 204, with the second barrier layer 206 providing a barrier between the heater layer 204 and the protective layer 208. Further, the first barrier layer 202 can be arranged on one side of the heater layer 204, with the second barrier layer 206 arranged on the opposing side or surface of the heater layer 204, such that the first barrier layer 202 and the second barrier layer 206 contact each other to encase, cover, and/or encapsulate the heater layer 204. In one example, though the heater layer 204 is provided between the first barrier layer 202 and the second barrier layer 206, the second barrier layer 206 is at least partially in direct contact with the first barrier layer 202, such as along an edge or an outer portion of the first barrier layer 202, encasing or enclosing and providing a waterproof barrier about the heater layer 204, as well as about the at least one electrical connector 210. In this way, when the immersible heater 90 is provided within the liquid sump 14, the encasing first and second barrier layers 202, 206 can be substantially surrounded by wash water or liquid during the cycle of operation.

The first and second barrier layers 202, 206 each comprise a liquid-impermeable material, which is also an electrically non-conductive or electrically resistive material. In one example, the first and second barrier layers 202, 206 each have an electrical conductivity $\sigma$ of less than $5\times10^{2}$-$5\times10^{7}$ S/m. At least one of the first and second barrier layers 202, 206 comprises a material that is also thermally conductive or thermally transmissive. By way of non-limiting example, the at least one of the first and second barrier layers 202, 206 that is thermally transmissive has a thermal conductivity $\lambda$ of at least 0.2-1 W/m K. The first and second barrier layers 202, 206 can be formed of any suitable material or combination of materials that falls within these ranges as desired. In one example, both the first and second barrier layers 202, 206 comprise a material that is liquid-impermeable, electrically non-conductive, and thermally transmissive. In such a case, the first and second barrier layers 202, 206 can comprise the same material(s) or can comprise different material(s) from one another. By way of non-limiting example, the first and second barrier layers 202, 206 can both comprise a polyimide film.

The protective layer 208 can be provided on and to at least partially abut the second barrier layer 206. The protective layer 208 can be provided directly onto the second barrier layer 206, though it will be understood that the protective layer 208 could be provided indirectly on the second barrier layer 206, such as by having an intervening layer or other component(s) provided between the second barrier layer 206 and the protective layer 208. By way of non-limiting example, the protective layer 208 can be coated onto the second barrier layer 206, though it will be understood that any suitable method of application can be used, other non-limiting examples of which can include laminating, spray coating, dip coating, painting, sputtering, or simply layering. By way of non-limiting example, the protective layer 208 can have a thickness of approximately 0.5-20 micrometers, further 10-20 micrometers. The protective layer 208 can be configured to thermally transmit heat that has been provided from the heater layer 204 and through the second barrier layer 206, as well as to provide further protection for the heater layer 204 and the at least one electrical connector 210, for example, protection against corrosion or impact. The protective layer 208 can be provided such that it encases, covers, and/or encapsulates the second barrier layer 206 and/or the support layer 96. The protective layer 208 can comprise any suitable material that can withstand high voltage, such as at least 1250V, non-limiting examples of which include polyurethane-based materials that can include a variety of additives for optimized performance parameters.

In one example, the protective layer 208 comprises a superhydrophobic nanocoating protective layer 208. The superhydrophobic nanocoating protective layer 208 provides lubricating or low friction properties or slipperiness to the laminate structure 200 and to the immersible heater 90 that can discourage or reduce the adhesion of limescale build-up on the immersible heater 90. In one example, the superhydrophobic nanocoating protective layer 208 comprises a nanocoating based on carbon-based nanoparticles and PTFE composites that can be applied on top of the second barrier layer 206. The carbon nanoparticles can be synthesized by heat-treating nanodiamond at temperatures between 1000° C. and 1900° C. The carbon particles are then milled using micron-sized beads in chemically treated water to yield nanometer-sized carbon particles, which are subsequently mixed with the PTFE at approximately 2% weight of carbon nanoparticles in PTFE. The resulting superhydrophobic nanocoating protective layer 208 can have a coefficient of friction of approximately 0.1 to prevent or reduce limescale adhesion, as well as being tolerant of the high temperatures produced by the immersible heater 90, in the range of 110° C. to 120° C.

While the immersible heater 90 is illustrated herein as having the laminate structure 200 provided on the support layer 96 of the heater body 92 and the mechanical vibrator 230 provided on the opposite surface 98 of the heater body 92, it will be understood that such an arrangement is not limiting. While it may be desirable to not provide the heater layer 204 and the mechanical vibrator 230 in overlapping positions, it is contemplated that, while the full laminate structure 200 may be provided on only one surface 96 of the heater body 92, the superhydrophobic nanocoating protective layer 208 on its own could be provided on portions of the heater body 92 that do not include the laminate structure 200, even such that the protective layer 208 is provided on the entirety of the heater body 92, including the portion of the heater body 92 to which the mechanical vibrator 230 is coupled.

Turning now to the operation of the immersible heater 90, the controller 18 of the household appliance 100 can cause the at least one electrical connector 210 to be energized. Specifically, the controller 18 can energize the power source 212 that is operably coupled to the at least one electrical connector 210, in order to cause the at least one electrical connector 210 to, in turn, be energized to thermoresistively heat the heater layer 204 to which the at least one electrical connector 210 is thermally coupled. As electrical current provided from the at least one electrical connector 210 by the power source 212 is provided to the heater layer 204, the carbon nanotubes conduct the electrical current by electron flow. When the electrical current and electron flow reaches or contacts the polymer, the polymer acts as an insulator to limit, inhibit, or interrupt further electron flow, causing the slowed or flow-limited electrons to heat up as they lose the energy of the electron flow, generating heat that can be provided outwardly from the heater layer 204. By optimizing the balance or relative concentrations of the conductive carbon nanotubes and the thermally insulating polymer, a performance of the heater layer 204 can be achieved to raise the temperature of the heater layer 204 in such a way that highly uniform surface heating through the thermoresistive heating capabilities of the heater layer 204 can be realized while requiring relatively less usage of electrical power from the power source 212 as compared to conventional coil or rod-type heating elements.

When the heater layer 204 is energized to be thermoresistively heated in this manner, the first barrier layer 202 may, in some examples, prevent thermal transfer, transmitting, or transmission of the heat inwardly from the heater layer 204 to the support layer 96. Since the second barrier layer 206 and the protective layer 208 are both configured to thermally transfer or transmit heat, the heat provided from the heater layer 204 can accordingly be transmitted outwardly from the heater layer 204 through the second barrier layer 206, and then further outwardly through the protective layer 208 in the direction shown by the arrows 220 and towards the liquid in the liquid sump 14. In the case that the first barrier layer 202 is also thermally transmissive, heat provided from the heater layer 204 can additionally be transmitted outwardly from the heater layer 204 through the first barrier layer 202, and then further to the heater body 92 in the direction opposite of the arrows 220. In this manner, the laminate structure 200 is configured to thermoresistively heat the immersible heater 90, and thus also the liquid within the liquid sump 14, by providing heat to the at least a portion of the liquid sump 14 to which the immersible heater 90 is provided adjacent and to the liquid in which the immersible heater 90 is submerged or partially submerged. Further, the first and second barrier layers 202, 206 and the protective layer 208 are liquid impermeable and encase the immersible heater 90 to protect the immersible heater 90 from corrosion.

Figure 4:
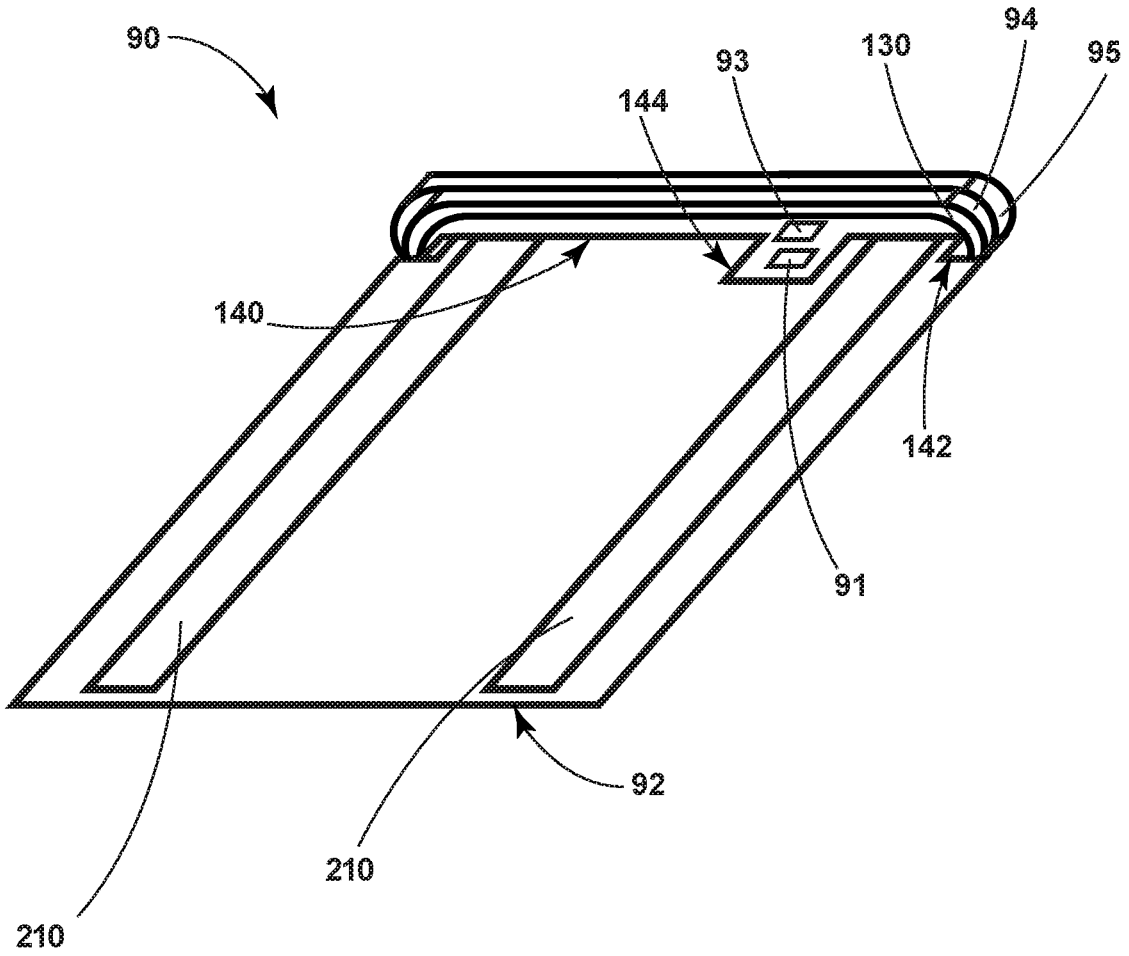
FIG. 4 is a schematic perspective view of the immersible heater of FIG. 1.

Turning now to FIG. 4, a portion of the immersible heater 90 illustrates an example of the coupling between the heater body 92 and the heater base 94. Specifically, the heater body 92 and the at least one electrical connector 210 are shown, without illustrating the full laminate structure 200, in order to better show the coupling between the heater body 92 and the heater base 94. The heater body 92 defines a peripheral portion, illustrated herein as a coupling edge 140 that at least partially forms the coupling to the heater base 94. The coupling edge 140 can be shaped or contoured to be complementary in profile to the heater base 94. In one non-limiting example, the heater base 94 includes an outer rim or a lip 130, with the heater body 92, and specifically the coupling edge 140, correspondingly including at least one cut out or notch 142 to accommodate the lip 130 in order to maximize the surface area of the heater body 92 for heating relative to the heater base 94. The inclusion of the at least one notch 142 allows the heater body 92 to have a width greater than the width of the portion of the heater base 94 that is bounded by the lip 130, while maintaining necessary contact with the heater base 94 for attachment. The heater body 92, and specifically the coupling edge 140, can further include at least one additional cut out or notch 144 to accommodate and allow space for at least one of the temperature sensor 91, the ground sensor 93, or the fastener 97. In the illustrated non-limiting example, the additional notch 144 is illustrated as a central notch 144, positioned between the notches 142 that accommodate the lip 130 of the heater base 94.

As described previously, the heater body 92 can be formed of a variety of suitable materials and the coupling of the heater body 92 with the heater base 94 can be accomplished in any suitable fashion. By way of non-limiting example, and in particular in the case when the heater body 92 and the heater base 94 are both formed of a metal or metal alloy, such as copper, steel, or aluminum, the heater body 92 can be arc welded to the heater base 94. In such an example, the coupling edge 140 of the heater body 92 is welded to the heater base 94. The coupling edge 140 can be welded to the heater base 94 across the entire portion of the coupling edge 140 where the notches 142, 144 are not present, or weld points can be positioned at any suitable points along the coupling edge 140 where the notches 142, 144 are not located. However, it will also be understood that the heater body 92, the coupling edge 140, and the heater base 94 with the lip 130 can have the same structure even when welding is not used as the attachment method. By way of further non-limiting example, the heater body 92 can comprise a printed circuit board (PCB) that may not be desirable for welding, so the PCB heater body 92 can be mechanically coupled to the heater base 94, such as by clamping. In such an example where clamping is used to couple the heater body 92 to the heater base 94, the heater base 94 can still be any suitable material, such as a metal or a metal alloy, or a non-metal material, such as a plastic, for example PTFE.

The at least one electrical connector 210 can extend along at least a portion of the heater body 92, up to and beyond the coupling edge 140. In such an example, the at least one electrical connector 210 extends beyond the coupling edge 140 to pass through the heater base 94, as well as to pass through the gasket 95, to operably and electrically couple with the wires 214, 216. A sealing material can be applied at the location where the at least one electrical connector 210 passes through the gasket 95 to ensure that liquid does not pass from the heater body 92 past the gasket 95 and to the non-immersible portion **94*b* of the immersible heater 90. By way of non-limiting example, an epoxy that can withstand high temperatures can be applied to the at least one electrical connector 210 and to the gasket 95 where the at least one electrical connector 210** passes through to provide a liquid seal.

In the process of assembling the immersible heater 90, in one non-limiting example, the coupling of the heater body 92 with the heater base 94 can be completed prior to the application of the laminate structure 200, such as by completing welding of the heater body 92 to the heater base 94 prior to the application of the laminate structure 200. Optionally, the first barrier layer 202 can be provided directly onto the heater body 92 that acts as the support layer 96. The at least one electrical connector 210 can then be provided on the first barrier layer 202, or, in the case that the first barrier layer 202 is not included, onto the support layer 96. The heater layer 204 is then provided over the at least one electrical connector 210 and any portion of the first barrier layer 202 or the support layer 96 that is not covered by the at least one electrical connector 210. The second barrier layer 206 is then provided on the heater layer 204, with the protective layer 208 provided on the second barrier layer 206.

By way of non-limiting example, the laminate structure 200 can be provided on the heater body 92 in an edge-to-edge manner to cover the heater body 92, and in particular the support layer 96. By way of further non-limiting example, the layers of the laminate structure 200, with the exception of the heater layer 204, are provided edge-to-edge on the heater body 92, while the heater layer 204 may not extend all the way to the coupling edge 140 of the heater body 92. For example, the heater layer 204 may be provided only up to a predetermined distance away from the coupling edge 140, such as approximately 35 millimeters away from the coupling edge 140. In this way, the laminate structure 200 can further be configured to act as a thermal fuse for the immersible heater 90. In traditional immersible heaters 90, thermal fuses are included to stop the operation of the immersible heater 90 in the case of a malfunction. With the immersible heater 90 and the laminate structure 200 of the present disclosure, thermal fuses need not be added as the laminate structure 200 itself functions as a thermal fuse. For example, if the laminate structure 200 is exposed to temperatures in excess of approximately 260° C.-280° C., the laminate structure 200 and its components and materials will break down due to the heat, stopping further operation of the heating by the heater layer 204, acting as its own thermal fuse.

Figure 5:
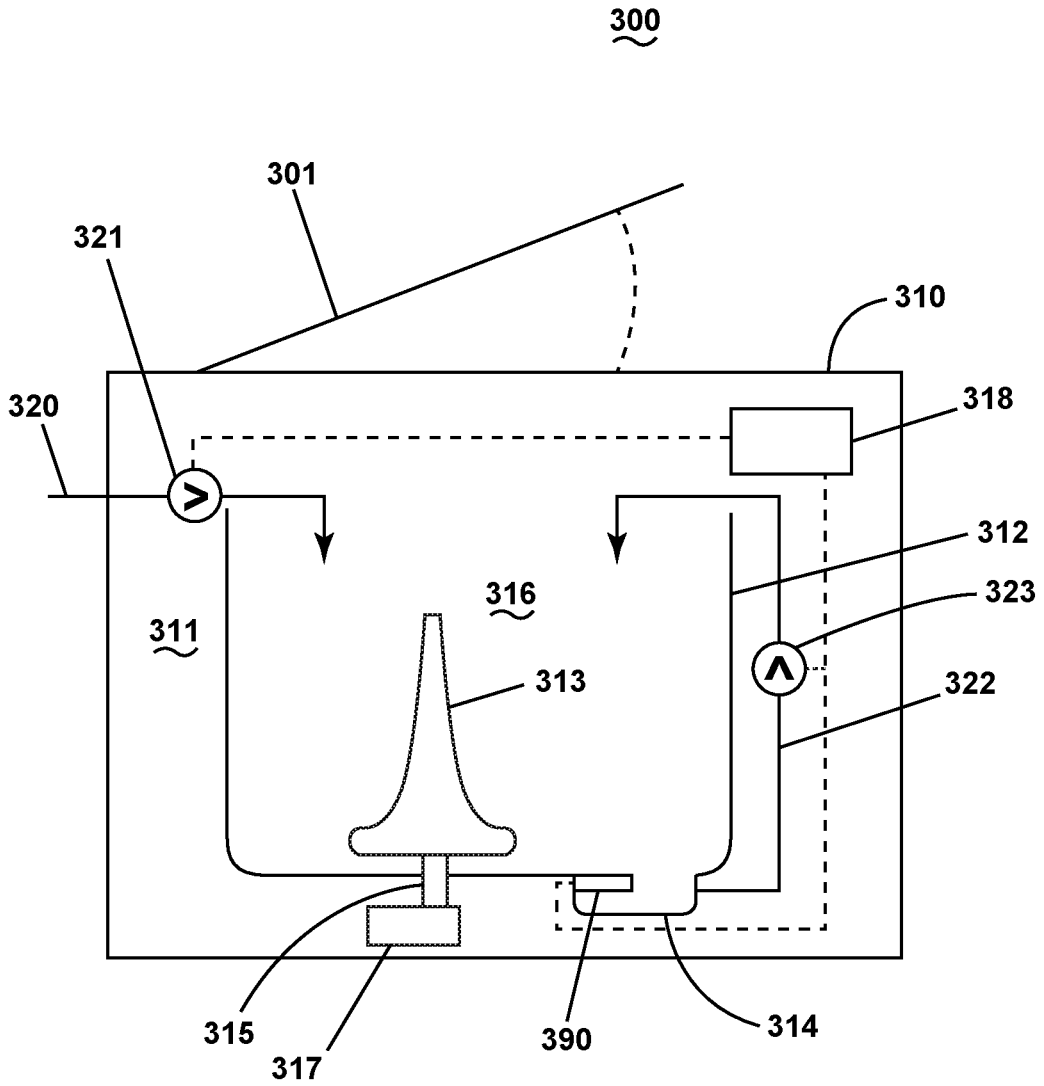
FIG. 5 is a schematic diagram showing the immersible heater of FIG. 1 in the environment of a vertical axis laundry treating appliance.

The immersible heater 90 can be used to heat liquid in household appliances 100 such as laundry treating appliances and dishwashers. An immersible heater 390 is shown in the environment of a vertical axis washer 300 in FIG. 5, which has components analogous to those described in FIG. 1, where the corresponding part numbers have increased by 300. The vertical axis washer 300 includes a door 301, a cabinet 310 with an interior 311, in which is provided a tub 312 that at least partially defines a treating chamber 316. A liquid sump 314 is fluidly coupled with the tub 312 and can be at least partially formed by the tub 312, or alternatively can be provided adjacent to or otherwise fluidly coupled with the tub 312. Alternatively, the liquid sump 314 can be a separate module that is coupled to the tub 312. The vertical axis washer 300 can further include an agitator 313, a drive shaft 315, and a motor 317.

The vertical axis washer 300 further includes a household water supply circuit in the form of a water supply line 320 and a water inlet valve 321, which controls the flow of water through the water supply line 320. The water supply line 320 can be fluidly coupled to a household water supply, thus, with the operation of the water inlet valve 321, water from the household water supply can be supplied to the treating chamber 316.

A liquid circuit 322 fluidly connects the liquid sump 314 to at least one of the treating chamber 316 or tub 312. A valve or a recirculation system pump 323 can control the flow of liquid through the liquid circuit 322. The liquid circuit 322 distributes or recirculates liquid from the liquid sump 314 to at least one of the treating chamber 316 or tub 312.

An immersible heater 390 can be included for heating the liquid in the liquid sump 314. By way of non-limiting example, the immersible heater 390 can be provided within or adjacent the treating chamber 316 or within or adjacent the liquid sump 314. The immersible heater 390 need only be located such that it is at least partially immersed in the liquid present within at least one of the treating chamber 316 or the liquid sump 314. As illustrated, the immersible heater 390 extends into and overlies at least a portion of the liquid sump 314, but does not lie on a surface of the liquid sump 314. However, it is contemplated that the immersible heater 390 can reside adjacent to or rest on a portion of the liquid sump 314. The immersible heater 390 can lie on the liquid sump or protrude into the liquid sump to heat the wash water that recirculates during operation.

To implement the cycles of operation, a controller 318 can also be included in the vertical axis washer 300 that operably couples with and controls the various components of the vertical axis washer 300 including the water inlet valve 321, the recirculation system pump 323, and the immersible heater 390, The controller 318 can be located within the cabinet as illustrated, or it can alternatively be located within a closure, such as a door, of the vertical axis washer 300.

Figure 6:
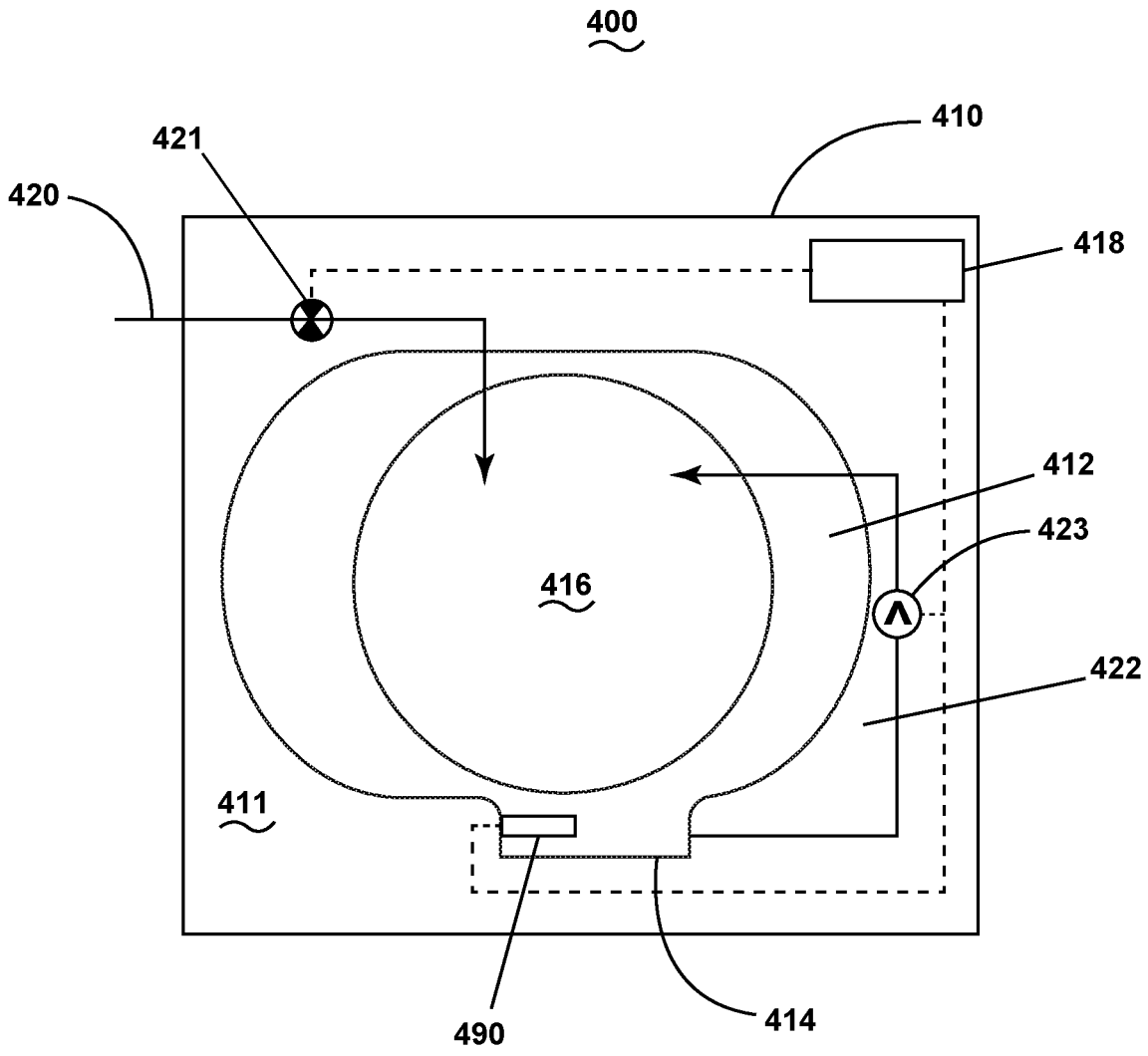
FIG. 6 is a schematic diagram showing the immersible heater of FIG. 1 in the environment of a horizontal axis laundry treating appliance.

FIG. 6 illustrates an immersible heater 490 in the environment of a horizontal axis washer 400. The horizontal axis washer 400 includes a cabinet 410 with an interior 411, a drum 412 that at least partially defines a treating chamber 416, a liquid sump 414, and other components analogous to those shown in FIG. 1, where the corresponding part numbers have increased by 400. The immersible heater 490 can lie on the liquid sump or protrude into the liquid sump to heat the wash water that recirculates during operation. A liquid sump 414 is fluidly coupled with the drum 412 and can be at least partially formed by the drum 412, or alternatively can be provided adjacent to or otherwise fluidly coupled with the drum 412. Alternatively, the liquid sump 414 can be a separate module that is coupled to the drum 412.

The horizontal axis washer 400 further includes a household water supply circuit in the form of a water supply line 420 and a water inlet valve 421, which controls the flow of water through the water supply line 420. The water supply line 420 can be fluidly coupled to a household water supply, thus, with the operation of the water inlet valve 421, water from the household water supply can be supplied to the treating chamber 416.

A liquid circuit 422 fluidly connects the liquid sump 414 to at least one of the treating chamber 416 or drum 412. A valve or a recirculation system pump 423 can control the flow of liquid through the liquid circuit 422. The liquid circuit 422 distributes or recirculates liquid from the liquid sump 414 to at least one of the treating chamber 416 or drum 412.

An immersible heater 490 can be included for heating the liquid in the liquid sump 414. By way of non-limiting example, the immersible heater 490 can be provided within or adjacent the treating chamber 416 or within or adjacent the liquid sump 414. The immersible heater 490 need only be located such that it is at least partially immersed in the liquid present within at least one of the treating chamber 416 or the liquid sump 414. As illustrated, the immersible heater 490 extends into and overlies at least a portion of the liquid sump 414, but does not lie on a surface of the liquid sump 414. However, it is contemplated that the immersible heater 490 can reside adjacent to or rest on a portion of the liquid sump 414.

To implement the cycles of operation, a controller 418 can also be included in the horizontal axis washer 400 that operably couples with and controls the various components of horizontal axis washer 400 including the water inlet valve 421, the recirculation system pump 423, and the immersible heater 490, The controller 418 can be located within the cabinet as illustrated, or it can alternatively be located within a closure, such as a door, of the horizontal axis washer 400.

Figure 7:
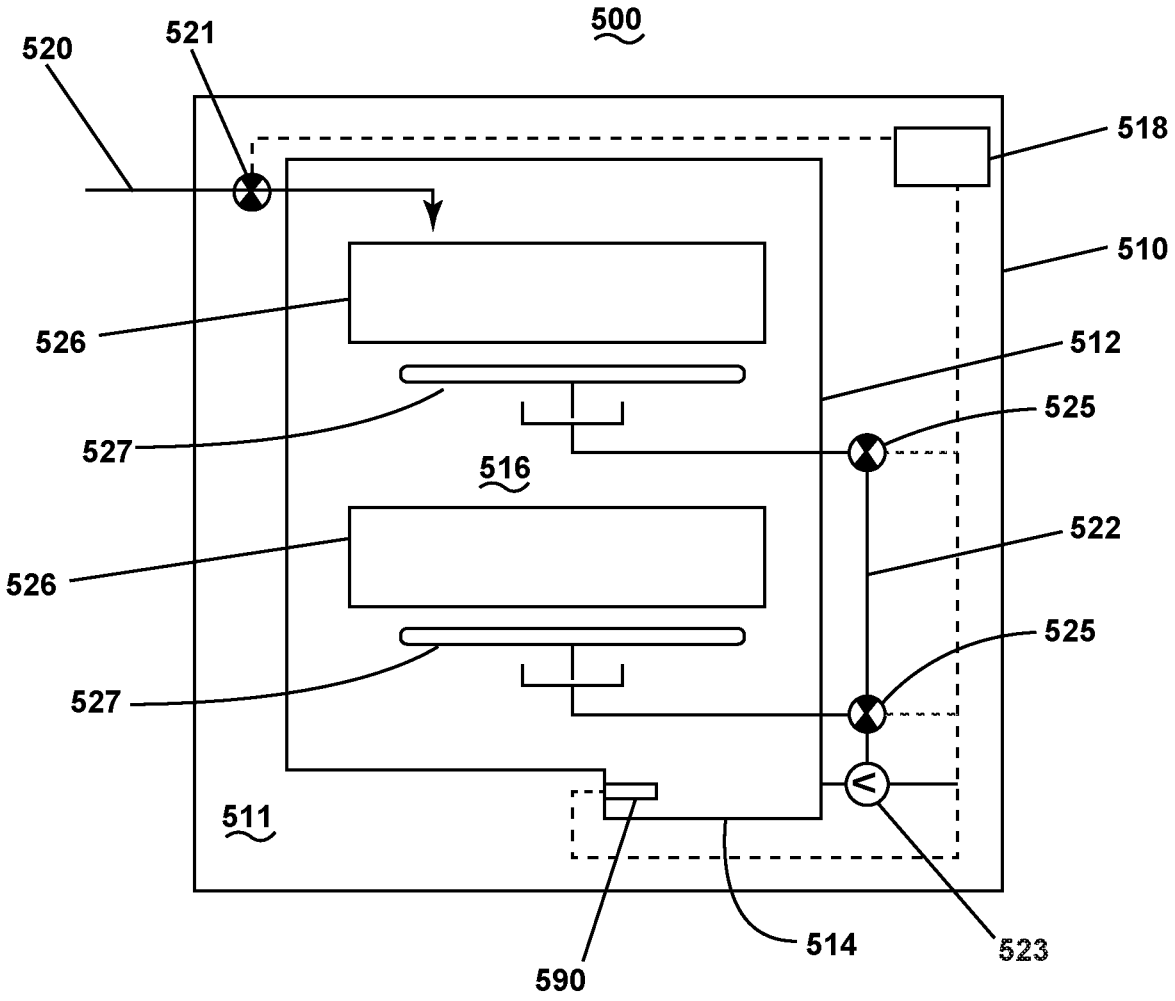
FIG. 7 is a schematic diagram showing the immersible heater of FIG. 1 in the environment of a dish treating appliance.

FIG. 7 illustrates an immersible heater 590 in the environment of a dishwasher 500. The dishwasher 500 includes components analogous to those shown in FIG. 1, where the corresponding part numbers have increased by 500. The dishwasher 500 includes a cabinet 510 with an interior 511 and a tub 512 that at least partially defines a treating chamber 516. A liquid sump 514 is fluidly coupled with the tub 512 and can be at least partially formed by the tub 512, or alternatively can be provided adjacent to or otherwise fluidly coupled with the tub 512. Alternatively, the liquid sump 514 can be a separate module that is coupled to the tub 512.

The dishwasher 500 further includes a household water supply circuit in the form of a water supply line 520 and a water inlet valve 521, which controls the flow of water through the water supply line 520. The water supply line 520 can be fluidly coupled to a household water supply, thus, with the operation of the water inlet valve 521, water from the household water supply can be supplied to the treating chamber 516.

A liquid circuit 522 fluidly connects the liquid sump 514 to at least one of the treating chamber 516 or tub 512. At least one valve 525 and a recirculation system pump 523 can control the flow of liquid through the liquid circuit 522. The liquid circuit 522 distributes or recirculates liquid from the liquid sump 514 to at least one of the treating chamber 516 or tub 512.

An immersible heater 590 can be included for heating the liquid in the liquid sump 514. By way of non-limiting example, the immersible heater 590 can be provided within or adjacent the treating chamber 516 or within or adjacent the liquid sump 514. The immersible heater 590 need only be located such that it is at least partially immersed in the liquid present within at least one of the treating chamber 516 or the liquid sump 514. As illustrated, the immersible heater 590 extends into and overlies at least a portion of the liquid sump 514, but does not lie on a surface of the liquid sump 514. However, it is contemplated that the immersible heater 590 can reside adjacent to or rest on a portion of the liquid sump 514.

To implement the cycles of operation, a controller 518 can also be included in the dishwasher 500 that operably couples with and controls the various components of dishwasher 500, including the water inlet valve 521, the recirculation system pump 523, and the immersible heater 590. The controller 518 can be located within the cabinet as illustrated, or it can alternatively be located within a closure, such as a door, of the dishwasher 500.

The dishwasher 500 further includes item holders 526 and spray arms 527 that are connected to the liquid circuit 522. The immersible heater 590 can lie on the liquid sump 514 or protrude into the liquid sump 514 to heat the wash water that recirculates during operation.

The aspects described herein can be used to provide an immersible heater for a household appliance that is adapted for immersion in water, as well as for thermoresistive heating. Having the laminate structure for thermoresistive heating can result in more efficient heating of the water and stability and durability of the heating element. The immersible heater set forth in the present disclosure also provides an immersible heater with a variety of anti-corrosion features. The laminate structure includes an outer protective layer that is superhydrophobic to provide a low friction, lubricating surface to discourage and reduce the adhesion of limescale and other corrosive compounds to the immersible heater, improving performance of the immersible heater over time as compared to immersible heaters without such anti-corrosion measures. Further yet, the inclusion of the mechanical vibrator further improves the anti-corrosion performance of the immersible heater as the vibration generated by the mechanical vibrator and transmitted to the immersible heater serves to further discourage the adhesion of limescale and other corrosion, as well as to dislodge limescale and other corrosion that may have already accumulated on the immersible heater when the mechanical vibrator is operated.

Further still, the design of the immersible heater with respect to the coupling of the heater body with the heater base and the provision and positioning of the electrical connectors and the laminate structure can improve the throughput, electrical safety, thermal stability, and temperature sensing ability of the immersible heater as compared to traditional types of immersible heaters. For example, the immersible heater with the laminate structure eliminates the need to include separate thermal fuses due to the laminate structure acting as its own thermal fuse. Throughput of the immersible heater is realized by the improved heating performance in terms of less time that is required to heat the water at relatively lower power consumption levels as compared to traditional rod or coil heating elements. The laminate structure serves to provide improved longevity and performance compared to traditional rod or coil heating elements because the laminate structure protects the immersible heater from leakage of current and protects from water reaching the heater body or the wires connecting to the electrical connectors. Improved ground connection features are also provided as the immersible heater as presently disclosed provides an immersible heater that is grounded through the heater body as well as at the ground sensor.

It will also be understood that various changes and/or modifications can be made without departing from the spirit of the present disclosure. By way of non-limiting example, although the present disclosure is described for use with an immersible heater including the laminate structure and the mechanical vibrator, it will be understood that an immersible heater including the laminate structure, but not the mechanical vibrator, or an immersible heater including the mechanical vibrator, but not the laminate structure, would be within the scope of the present disclosure and would still confer anti-corrosion benefits to the immersible heater.

To the extent not already described, the different features and structures of the various aspects can be used in combination with each other as desired. That one feature is not illustrated in all of the aspects is not meant to be construed that it cannot be, but is done for brevity of description. Thus, the various features of the different aspects can be mixed and matched as desired to form new aspects, whether or not the new aspects are expressly described. Combinations or permutations of features described herein are covered by this disclosure.

This written description uses examples to disclose aspects of the disclosure, including the best mode, and also to enable any person skilled in the art to practice aspects of the disclosure, including making and using any devices or systems and performing any incorporated methods. While aspects of the disclosure have been specifically described in connection with certain specific details thereof, it is to be understood that this is by way of illustration and not of limitation. Reasonable variation and modification are possible within the scope of the forgoing disclosure and drawings without departing from the spirit of the disclosure, which is defined in the appended claims. Hence, specific dimensions and other physical characteristics relating to the aspects of the present disclosure are not to be considered as limiting, unless expressly stated otherwise.

What is claimed is:

1. A household appliance configured to implement an automatic cycle of operation for treating an article, the household appliance comprising:

a treating chamber configured to receive the article for treatment according to the automatic cycle of operation;

a sump fluidly coupled to the treating chamber;

a liquid circuit fluidly coupled to at least one of the treating chamber or the sump;

an immersible heater located within the sump, wherein the immersible heater is an immersible laminate heater having a support layer and a pair of electrodes and a laminate structure provided on the support layer with the laminate structure comprising:

a thermoresistive nano-coating heater layer electrically connected to the pair of electrodes;

a first liquid-impermeable and electrically non-conductive barrier layer provided between the support layer and the thermoresistive nano-coating heater layer;

a second liquid-impermeable and electrically non-conductive barrier layer abutting the thermoresistive nano-coating heater layer; and a superhydrophobic nano-coating protective layer abutting the second liquid-impermeable and electrically non-conductive barrier layer; and a mechanical vibrator physically coupled to the immersible heater.

2. The household appliance of claim 1 wherein the laminate structure is provided on a first surface of the support layer and the mechanical vibrator is coupled to a second surface of the support layer, the second surface opposite the first surface.

3. The household appliance of claim 1 wherein the support layer is a metal plate.

4. The household appliance of claim 1 wherein the mechanical vibrator is an electromagnetic mechanical vibrator.

5. The household appliance of claim 1 wherein the mechanical vibrator is operable at a single constant frequency.

6. The household appliance of claim 1 wherein the mechanical vibrator is operable at variable frequencies.

7. A household appliance configured to implement an automatic cycle of operation for treating an article, the household appliance comprising:

a treating chamber;

a sump fluidly coupled to the treating chamber;

a liquid circuit fluidly coupled to at least one of the treating chamber or the sump; and an immersible laminate heater located within the sump and having a support layer, a pair of electrodes, and a laminate structure provided on the support layer with the laminate structure comprising:

a thermoresistive nano-coating heater layer electrically connected to the pair of electrodes;

a first liquid-impermeable and electrically non-conductive barrier layer provided between the support layer and the thermoresistive nano-coating heater layer;

a liquid-impermeable and electrically non-conductive second barrier layer abutting the thermoresistive nano-coating heater layer; and a superhydrophobic nano-coating protective layer abutting the liquid-impermeable and electrically non-conductive second barrier layer.

8. The household appliance of claim 7, further comprising a mechanical vibrator coupled to the immersible laminate heater and configured to mechanically vibrate the immersible laminate heater.

9. The household appliance of claim 7 wherein the first liquid-impermeable and electrically non-conductive barrier layer, the liquid-impermeable and electrically non-conductive second barrier layer, and the superhydrophobic nano-coating protective layer are thermally transmissive.

10. The household appliance of claim 7 wherein at least one of the first liquid-impermeable and electrically non-conductive barrier layer and the liquid-impermeable and electrically non-conductive second barrier layer are thermally transmissive.

11. The household appliance of claim 7 wherein the superhydrophobic nano-coating protective layer has low friction properties to prevent adhesion of limescale to the superhydrophobic nano-coating protective layer.

12. The household appliance of claim 7 wherein the superhydrophobic nano-coating protective layer has a thickness of 0.5 to 20 microns.

13. An immersible heating element assembly, comprising:

an immersible heating element comprising a support layer and a pair of electrodes;

a mechanical vibrator coupled to the immersible heating element and configured to mechanically vibrate the immersible heating element; and a laminate structure provided on the support layer, the laminate structure comprising:

a thermoresistive nano-coating heater layer electrically connected to the pair of electrodes;

a first liquid-impermeable and electrically non-conductive barrier layer provided between the support layer and the thermoresistive nano-coating heater layer;

a liquid-impermeable and electrically non-conductive second barrier layer abutting the thermoresistive nano-coating heater layer; and a superhydrophobic nano-coating protective layer abutting the liquid-impermeable and electrically non-conductive second barrier layer.

14. The immersible heating element of claim 13 wherein the immersible heating element is a non-tubular heating element.

15. The immersible heating element assembly of claim 13 wherein the support layer is a metal plate.

16. The immersible heating element assembly of claim 13 wherein the mechanical vibrator is an electromagnetic mechanical vibrator.

17. The immersible heating element assembly of claim 13 wherein the mechanical vibrator is operable at a single constant frequency.

18. The immersible heating element assembly of claim 13 wherein at least one of the first liquid-impermeable and electrically non-conductive barrier layer and the liquid-impermeable and electrically non-conductive second barrier layer are thermally transmissive.

19. The immersible heating element assembly of claim 13 wherein the superhydrophobic nano-coating protective layer has a thickness of 0.5 to 20 microns.

* * * * *